US006494038B2

(12) United States Patent
Kobayashi et al.

(10) Patent No.: US 6,494,038 B2
(45) Date of Patent: Dec. 17, 2002

(54) ENGINE AIR-FUEL RATIO CONTROLLER

(75) Inventors: Hideaki Kobayashi, Yokohama (JP); Shigeaki Kakizaki, Yokohama (JP); Masatomo Kakuyama, Yokohama (JP); Osamu Matsuno, Ayase (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/790,899

(22) Filed: Feb. 23, 2001

(65) Prior Publication Data

US 2001/0045089 A1 Nov. 29, 2001

(30) Foreign Application Priority Data

Feb. 23, 2000 (JP) ..... 2000-046098
Feb. 23, 2000 (JP) ..... 2000-046104

(51) Int. Cl.[7] ..... F01N 3/00
(52) U.S. Cl. ..... 60/285; 60/274; 60/276; 60/277
(58) Field of Search ..... 60/274, 276, 277, 60/285; 123/688, 679

(56) References Cited

U.S. PATENT DOCUMENTS 5,154,054 A * 10/1992 Nakane et al. ..... 60/277
5,337,555 A * 8/1994 Tokuda et al. ..... 60/277
5,337,558 A * 8/1994 Komatsu ..... 60/277
5,475,975 A * 12/1995 Nasu ..... 60/276
5,485,826 A * 1/1996 Ohata et al. ..... 123/679
5,542,248 A * 8/1996 Iwata et al. ..... 60/277
5,622,047 A * 4/1997 Yamashita et al. ..... 60/285
5,743,086 A * 4/1998 Nagai ..... 60/277
5,842,340 A 12/1998 Bush et al. ..... 60/274
5,845,489 A * 12/1998 Dohta et al. ..... 60/277
6,176,080 B1 * 1/2001 Izumiura et al. ..... 60/277

FOREIGN PATENT DOCUMENTS

JP 5-195842 8/1993
JP 7-259602 10/1995

OTHER PUBLICATIONS

U.S. patent application Ser. No. 09/418255, Tayama et al., filed Oct. 15, 1999.

* cited by examiner

*Primary Examiner*—Thomas Denion
*Assistant Examiner*—Tu M. Nguyen
(74) *Attorney, Agent, or Firm*—Foley & Lardner

(57) ABSTRACT

A catalyst 3 which has oxygen storage performance is installed in an engine exhaust passage 2, an oxygen storage amount is estimated based on the output of an upstream air-fuel ratio sensor 4 installed in the upstream of the catalyst 3, and an air-fuel ratio is controlled so that this oxygen storage amount coincides with a target value. When the output of a downstream air-fuel ratio sensor 5 has become lean or rich for longer than a fixed time, the output of the upstream air-fuel ratio sensor 4 is corrected based on the output of the downstream air-fuel ratio sensor 5 placed in the downstream of the catalyst 3. In this way, the output fluctuation due to deterioration of the air-fuel ratio sensor 4 upstream of the catalyst is corrected, and the catalyst oxygen storage amount is always precisely controlled to the target value.

22 Claims, 13 Drawing Sheets

ENGINE AIR-FUEL RATIO CONTROLLER

FIELD OF THE INVENTION

This invention relates to an air-fuel ratio controller of an engine.

BACKGROUND OF THE INVENTION

A catalyst which purifies engine exhaust known in the art which has oxygen storage capacity, absorbs oxygen when the air-fuel ratio of the exhaust is lean, and releases the absorbed oxygen when the air-fuel ratio of the exhaust is rich. This is disclosed in JP 5-195842A and JP 7-259602A which are Japanese Patent Publications.

Therefore, in this catalyst, when the air-fuel ratio of the exhaust varies slightly from stoichiometric to rich or lean, the catalyst atmosphere can be maintained at stoichiometric so that oxidation of HC, CO and reduction of NOx are both performed well.

SUMMARY OF THE INVENTION

However, there is a limit to the oxygen storage amount of the catalyst. If this is exceeded, the catalyst atmosphere becomes lean, and moreover, when the air-fuel ratio is rich and the oxygen storage amount becomes zero, the catalyst atmosphere becomes rich.

As a result, if the air-fuel ratio is controlled so that the oxygen storage amount of the catalyst is always about ½ of the maximum oxygen storage amount, the oxygen absorption and release capacities of the catalyst are equalized so that it is possible to cope when the air-fuel ratio fluctuates to either rich or lean from stoichiometric.

For this purpose, it determines whether the oxygen in the exhaust flowing into the catalyst is insufficient or excessive based on the detection value of this air-fuel ratio sensor placed upstream of the catalyst, estimates the oxygen amount stored in the catalyst, and controls an air-fuel ratio so that this storage amount is a target value.

However, as the air-fuel ratio sensor installed upstream of the catalyst comes in direct contact with high temperature exhaust, its performance deteriorates due to the effect of the hot exhaust, and errors may appear in the detection of the air-fuel ratio. In this case, the output of the air-fuel ratio sensor shifts relatively to either rich or lean. This may also occur due to scatter in the quality of the air-fuel ratio sensor when it is manufactured.

If there are errors in the detected air-fuel ratio, the computation of the oxygen storage amount in the catalyst which is based on the output of the air-fuel ratio sensor may be incorrect, and it may be difficult to precisely control the oxygen storage amount of the catalyst to the target value. In this case, the exhaust purification efficiency of the catalyst decreases.

It is therefore an object of this invention to correctly determine whether or not there are errors in the output of an air-fuel ratio sensor.

It is a further object of this invention to correct output errors when such errors occur in the output of the air-fuel ratio sensor, and precisely control the oxygen storage amount to the target value.

In order to achieve the above object, the invention provides an engine air-fuel ratio controller which comprises a catalyst installed in an exhaust passage which absorbs oxygen when an exhaust air-fuel ratio is lean, and releases the absorbed oxygen when the exhaust air-fuel ratio is rich, an air-fuel ratio sensor installed upstream of the catalyst, which detects an air-fuel ratio upstream of the catalyst, an air-fuel ratio sensor installed downstream of the catalyst, which detects an air-fuel ratio downstream of the catalyst, and a microprocessor.

The microprocessor is programmed to control a fuel supply amount of the engine to obtain the stoichiometric air-fuel ratio, which is a target air-fuel ratio, based on the detection value of the upstream air-fuel ratio sensor, to estimate the oxygen storage amount absorbed by the catalyst based on the detection value of the upstream air-fuel ratio sensor, to modify the target air-fuel ratio so that the estimated oxygen storage amount coincides with the target value, and to determine whether or not there is an error in the output of the upstream air-fuel ratio sensor based on the detection value of the downstream air-fuel ratio sensor, and correct the detection value of the upstream air-fuel sensor according to this determination result, and determine that there is a fault in the upstream air-fuel ratio sensor when the absolute value of the integral of the detection values of the upstream air-fuel ratio sensor exceeds a predetermined value.

The details as well as other features and advantages of the invention are set forth in the remainder of the specification and are shown in the accompanying drawings.

DESCRIPTION OF THE PREFERRED EMBODIMENTS

Figure 1:
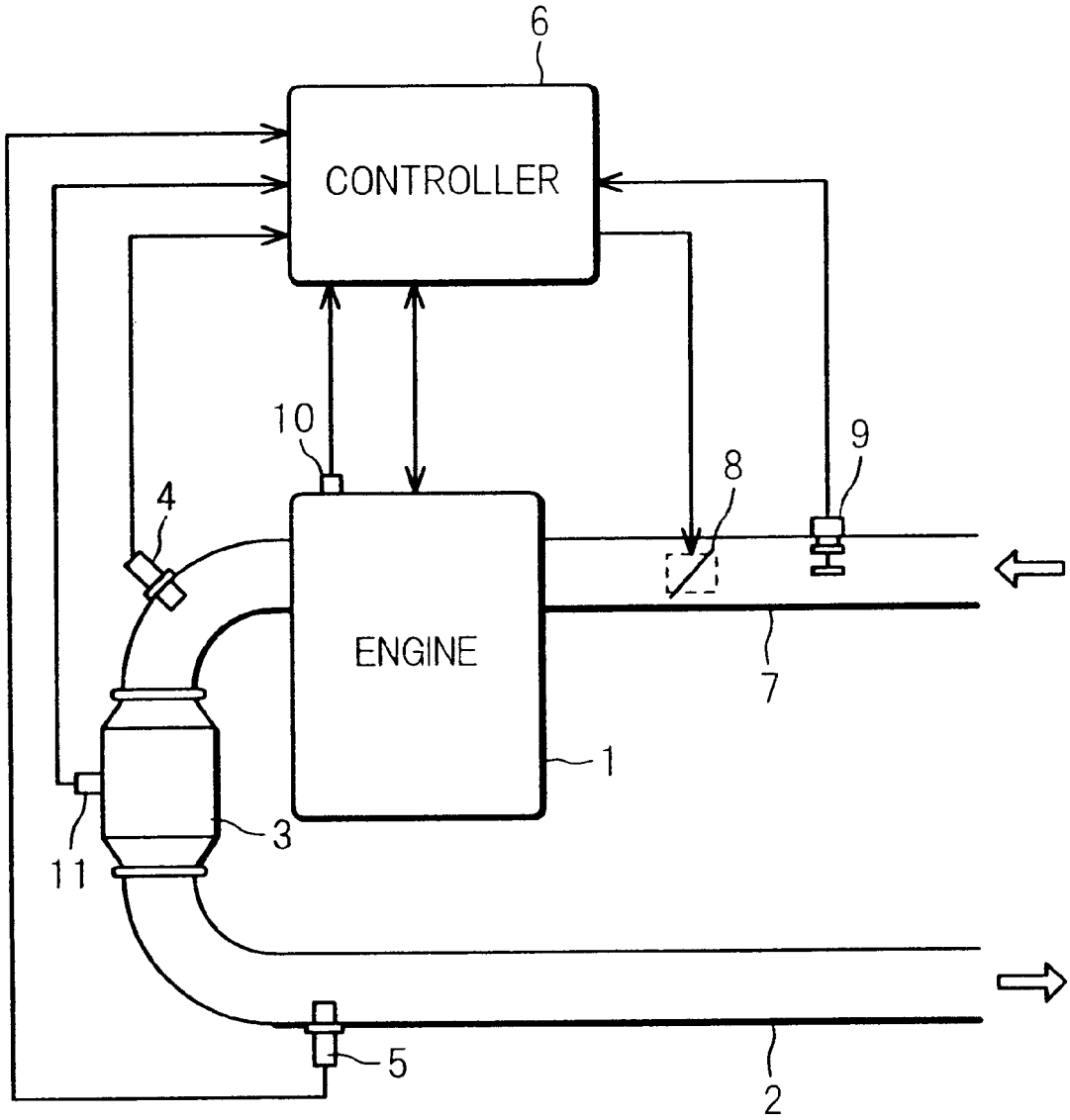
FIG. 1 is a schematic view of this invention.

FIG. 1 shows a schematic view of an exhaust purification device to which this invention is applied.

A catalyst 3 is installed in an exhaust passage 2 of an engine 1, a linear air-fuel ratio sensor 4 is installed upstream of the catalyst 3 and an air-fuel ratio sensor (or oxygen sensor) 5 is installed downstream of the catalyst 3. A controller 6 which controls the ratio of fuel to air supplied to the engine 1 based on the output of these sensors, i.e., the air-fuel ratio, is further provided.

A throttle valve 8, and an air flow meter 9 which measures the intake air amount adjusted by the throttle valve 8, are also installed in an intake passage 7 of the engine 1.

The catalyst 3 is a three-way catalyst, and NOx, HC, CO are purified with maximum efficiency when the catalyst atmosphere is stoichiometric. This catalyst 3 is comprised of a catalyst support coated with an oxygen storage material such as a noble metal or ceria, etc. A catalyst temperature sensor 11 detects an actual temperature of the catalyst 3.

The catalyst 3 functions to absorb oxygen in the exhaust when the air-fuel ratio of the exhaust flowing into the catalyst is lean, and release the stored oxygen when the air-fuel ratio is rich. In this way, the catalyst atmosphere (air-fuel ratio downstream of the catalyst) is maintained at stoichiometric, and the exhaust purification efficiency is always optimum. The air-fuel ratio sensor 4 installed upstream of the catalyst 3 has linear output characteristics depending on the air-fuel ratio of the exhaust, and the output of the downstream air-fuel ratio sensor 5 varies in an approximately ON/OFF fashion according to the oxygen concentration of the exhaust.

A water temperature sensor 10 which detects a temperature of cooling water is attached to the engine 1, and its output is used to determine the running state of the engine 1 and the activation state of the catalyst 3.

The controller 6 is a microprocessor which comprises CPU, RAM, ROM and I/O interface.

The controller 6 computes the storage amount of the oxygen absorbed by the catalyst 3 based on the output of the air flow meter 9 and the output of the upstream air-fuel ratio sensor 4, and the air-fuel ratio is feedback-controlled so that this storage amount is a target value. In other words, when the computed oxygen storage amount is less than the target value, the target air-fuel ratio supplied to the engine 1 is adjusted to lean to increase the oxygen storage amount of the catalyst 3, and when the computed oxygen storage amount is more than the target value, the target air-fuel ratio supplied to the engine 1 is adjusted to rich to decrease the oxygen storage amount of the catalyst 3. In this way, the oxygen storage amount is made to coincide with the target value.

The computation of the catalyst oxygen storage amount is performed based on the following principle.

Specifically, an oxygen excess rate is known which is an excess or deficiency of oxygen in the exhaust based on the exhaust air-fuel ratio upstream of the catalyst 3. The oxygen excess rate is positive when the air-fuel ratio is lean and negative when it is rich, and is zero at the stoichiometric air-fuel ratio.

The oxygen amount absorbed by the catalyst 3 or the oxygen amount released therefrom is known from the oxygen excess rate and intake air amount at this time, and the oxygen storage amount of the catalyst 3 may be estimated by integrating this. When the air-fuel ratio is rich, oxygen is released from the catalyst 3, and the oxygen storage amount of the catalyst 3 decreases. When the air-fuel ratio is lean, oxygen is absorbed, so the oxygen storage amount increases.

When the oxygen storage amount of the catalyst 3 reaches saturation, the air-fuel ratio downstream of the catalyst 3 becomes lean. In this state, no more oxygen can be trapped, and it is therefore discharged downstream. During fuel cut, which is a special engine running condition, only air is contained in the exhaust, and in this state the oxygen storage amount of the catalyst 3 is saturated, i.e. it is a maximum value.

When the air-fuel ratio downstream of the catalyst 3 is rich, all the oxygen is released from the catalyst 3, and the oxygen storage amount of the catalyst 3 is zero.

Therefore, taking the time when the air-fuel ratio downstream of the catalyst 3 is lean or rich as a reference, the present oxygen storage amount may be found by integrating the oxygen storage amount of the catalyst 3 thereafter. The air-fuel ratio is controlled by verifying the maximum oxygen storage amount of the catalyst 3 by experiment beforehand, setting for example half of this storage amount as a target value, and making the oxygen storage amount coincide with this target value.

However, the air-fuel ratio of a real engine is basically feedback-controlled to the stoichiometric air-fuel ratio which is the target air-fuel ratio. Therefore, to make the oxygen storage amount coincide with the target value, a value corresponding to a deviation from the target value of the oxygen storage amount relative to the above target air-fuel ratio is given as a correction value. At this time, the oxygen storage amount can be made to converge to the target value without the real air-fuel ratio fluctuating much from the stoichiometric air-fuel ratio by limiting the magnitude of the correction value on each occasion.

Here, a specific computation of the aforesaid oxygen storage amount of the catalyst 3 and air-fuel ratio, and the control method employed, will be described referring to FIG. 2 to FIG. 6.

The oxygen storage characteristics of the catalyst 3 may be divided into absorption/release at high speed by a noble metal in the catalyst, and absorption/release at low speed by an oxygen storage material such as ceria in the catalyst. Therefore, the real storage amount can be precisely computed according to the catalyst characteristic by computing the oxygen storage amount separately for the high-speed and low speed components in line with this characteristic.

Figure 2:
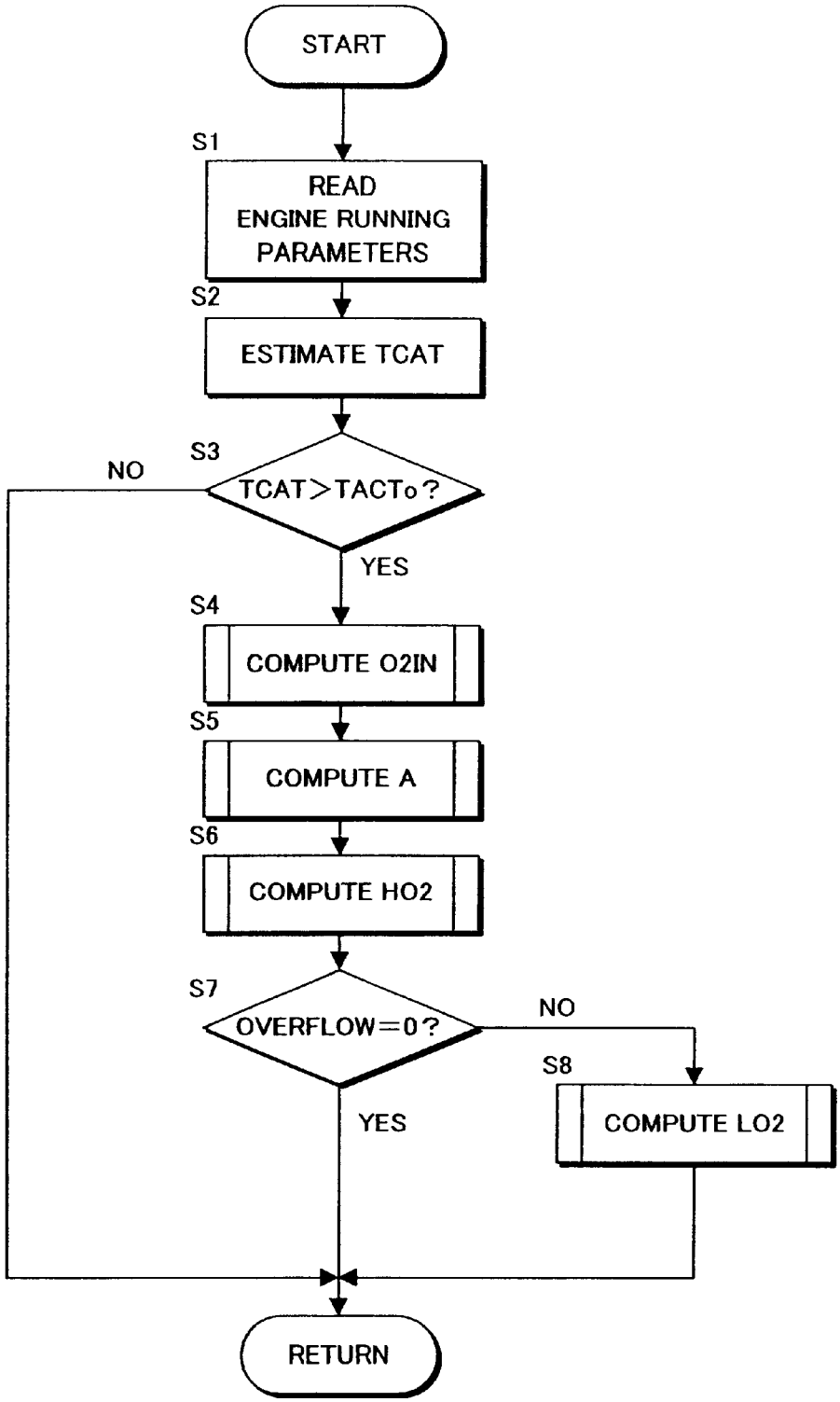
FIG. 2 is a flowchart showing a routine for computing an oxygen storage amount of the catalyst.

FIG. 2 is a flowchart for computing the oxygen storage amount of the catalyst 3, is performed at a predetermined interval.

According to this routine, first, in a step S1, cooling water temperature, crank angle and intake air flow are read as running parameters of the engine 1. In a step S2, a temperature TCAT of the catalyst 3 is estimated based on these parameters. In a step S3, by comparing the estimated catalyst temperature TCAT and a catalyst activation temperature TACTo, it is determined whether or not the catalyst 3 has activated.

When it is determined that the catalyst activation temperature TACTo has been reached, the routine proceeds to a step S4 to compute the oxygen storage amount of the catalyst 3. When it is determined that the catalyst activation temperature TACTo has not been reached, processing is terminated assuming that the catalyst 3 does not store or release oxygen.

In the step S4, a subroutine (FIG. 3) for computing an oxygen excess/deficiency amount O2IN is performed, and the oxygen excess/deficiency amount of the exhaust flowing into the catalyst 3 is computed. In a step S5, a subroutine (FIG. 4) for computing an oxygen release rate A of the high speed component of the oxygen storage amount is performed, and the oxygen release rate A of the high speed component is computed.

Further, in a step S6, a subroutine (FIG. 5) for computing the high speed component HO2 of the oxygen storage amount is performed, and the high speed component HO2 and an oxygen amount OVERFLOW overflowing into the low speed component LO2 without being stored as the high speed component HO2, are computed based on the oxygen excess/deficiency amount O2IN and the oxygen release rate A of the high speed component.

In a step S7, it is determined whether or not all of the oxygen excess/deficiency amount O2IN flowing into the catalyst 3 has been stored as the high speed component HO2 based on the overflow oxygen amount OVERFLOW. When all of the oxygen excess/deficiency amount O2IN has been stored as the high speed component (OVERFLOW=O), processing is terminated. In other cases, the routine proceeds to a step S8, a subroutine (FIG. 6) is performed for computing the low speed component LO2, and the low speed component LO2 is computed based on the overflow oxygen amount OVERFLOW overflowing from the high speed component HO2.

Here, the catalyst temperature TCAT is estimated from the cooling water temperature of the engine 1, the engine load and the engine rotation speed, but a temperature of the catalyst 3 measured directly.

When the catalyst temperature TCAT is less than the activation temperature TACTo, the oxygen storage amount is not computed, but the step S3 may be eliminated, and the effect of the catalyst temperature TCAT may be reflected in the oxygen release rate A of the high speed component or an oxygen storage/release rate B of the low speed component, described later.

Next, a subroutine performed from steps S4 to S6 and in the step S8 will be described.

Figure 3:
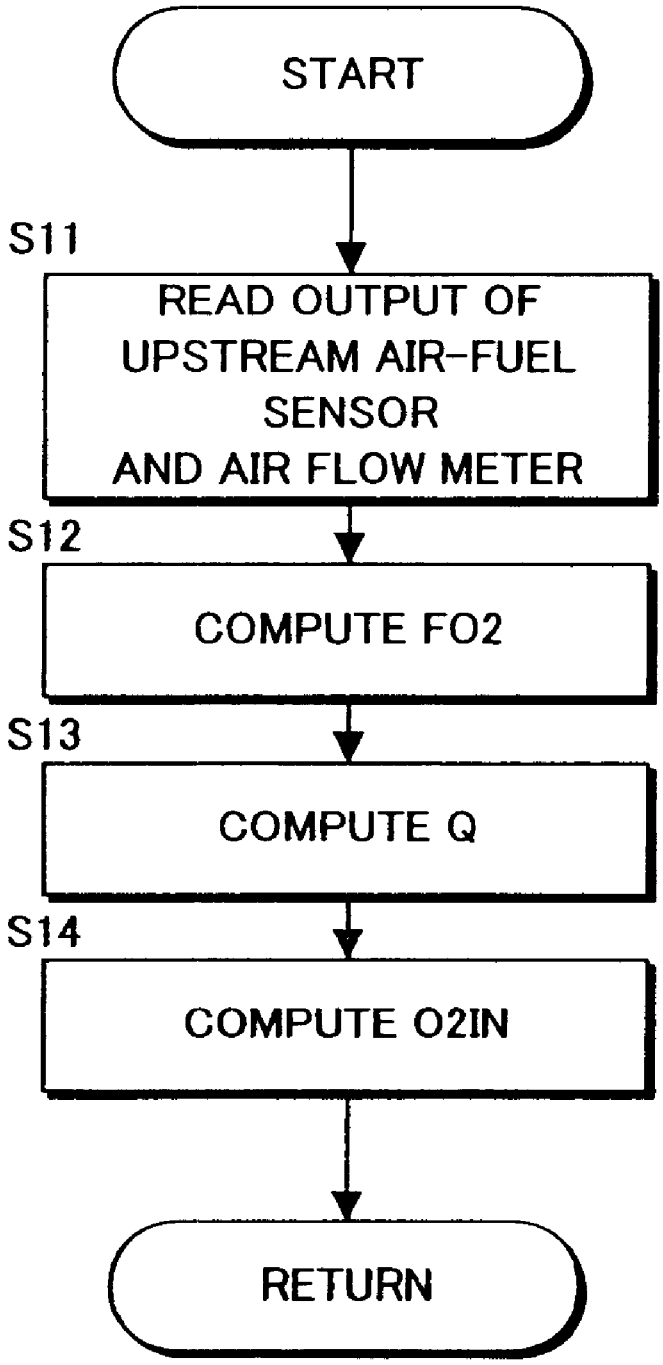
FIG. 3 is a flowchart showing a subroutine for computing an oxygen excess/deficiency amount in exhaust flowing into the catalyst.

FIG. 3 shows the subroutine for computing the oxygen excess/deficiency amount O2IN of the exhaust flowing into the catalyst 3. In this subroutine, the oxygen excess/deficiency amount O2IN of the exhaust flowing into the catalyst 3 is computed based on the air-fuel ratio of the exhaust upstream of the catalyst 3 and the intake air amount of the engine 1.

First, in a step S11, the output of the upstream air-fuel sensor 4 and the output of the air flow meter 9 are read.

Next, in a step S12, the output of the upstream air-fuel sensor 4 is converted to an excess/deficiency oxygen concentration FO2 of the exhaust flowing into the catalyst 3 using a predetermined conversion table. Here, the excess/deficiency oxygen concentration FO2 is a relative concentration based on the oxygen concentration at the stoichiometric air-fuel ratio. If the exhaust air-fuel ratio is equal to the stoichiometric air-fuel ratio, it is zero, if it is richer than the stoichiometric air-fuel ratio it is negative, and if it is leaner than the stoichiometric air-fuel ratio, it is positive.

In a step S13, the output of the air flow meter 9 is converted to an intake air amount Q using a predetermined conversion table, and in a step S14, the intake air amount Q is multiplied by the excess/deficiency oxygen concentration FO2 to compute the excess/deficiency oxygen amount O2IN of the exhaust flowing into the catalyst 3.

As the excess/deficiency oxygen concentration FO2 has the above characteristics, the excess/deficiency oxygen amount O2IN is zero when the exhaust flowing into the catalyst 3 is at the stoichiometric air-fuel ratio, a negative value when it is rich, and a positive value when it is lean.

Figure 4:
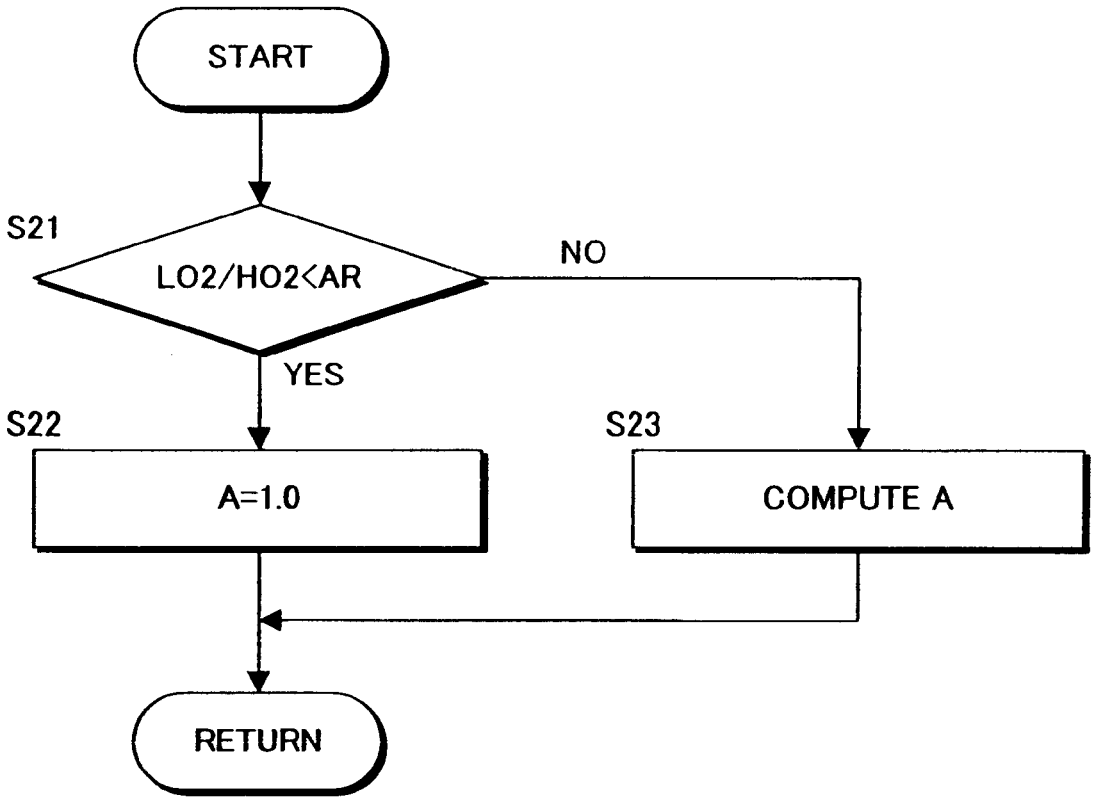
FIG. 4 is a flowchart showing a subroutine for computing an oxygen release rate of a high speed component.

FIG. 4 shows a subroutine for computing the oxygen release rate A of the high speed component of the oxygen storage amount. In this subroutine, as the oxygen release rate of the high speed component HO2 is affected by the low speed component LO2, the oxygen release rate A of the high speed component is computed according to the low speed component LO2.

First, in a step S21, it is determined whether or not a ratio LO2/HO2 of low speed component relative to the high speed component is less than a predetermined value AR. When it is determined that the ratio LO2/HO2 is less than the predetermined value AR, i.e., when the high speed component HO2 is relatively larger than the low speed component LO2, the routine proceeds to a step S22, and the oxygen release rate A of the high speed component is set to 1.0 expressing the fact that oxygen is released first from the high speed component HO2.

On the other hand, when it is determined that the ratio LO2/HO2 is not less than the predetermined value AR, oxygen is released from the high speed component HO2 and the low speed component LO2 so that the ratio of the low speed component LO2 to the high speed component HO2 does not vary. The routine then proceeds to a step S23, and a value of the oxygen release rate A of the high speed component is computed which does not cause the ratio LO2/HO2 to vary.

Figure 5:
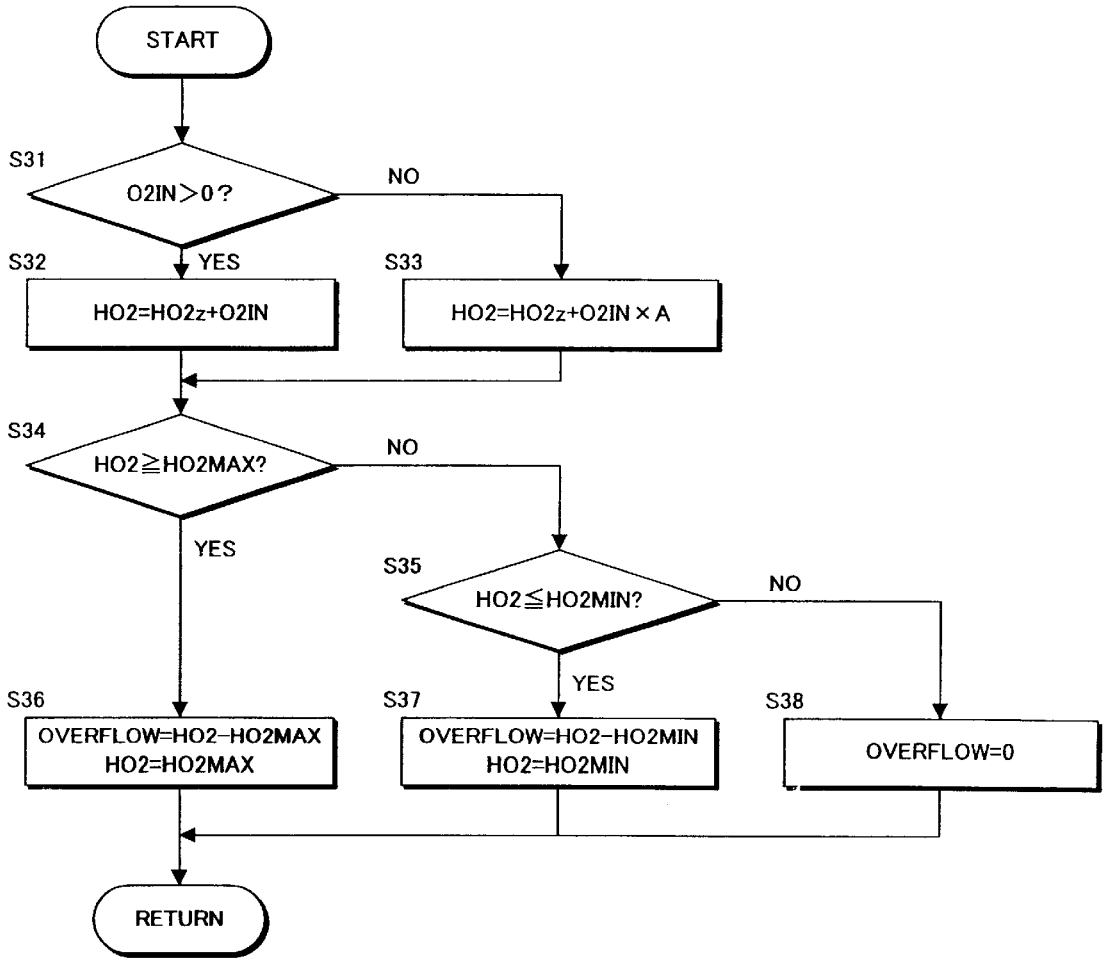
FIG. 5 is a flowchart showing a subroutine for computing the high speed component of the oxygen storage amount.

FIG. 5 shows a subroutine for computing the high speed component HO2 of the oxygen storage amount. In this subroutine, the high speed component HO2 is computed based on the oxygen excess/deficiency amount O2IN of the exhaust flowing into the catalyst 3 and the oxygen release rate A of the high speed component.

First, it is determined in a step S31 whether or not the high speed component HO2 is being stored or released based on the oxygen excess/deficiency amount O2IN.

When the air-fuel ratio of the exhaust flowing into the catalyst 3 is lean and the oxygen excess/deficiency amount O2IN is larger than zero, it is determined that the high speed component HO2 is being stored, the routine proceeds to a step S32, and the high speed component HO2 is computed from the following equation (1):

$$HO2=HO2z+O2IN \quad (1)$$

where: HO2z=value of high speed component HO2 on immediately preceding occasion.

On the other hand, when it is determined that the oxygen excess/deficiency amount O2IN is less than zero and the high speed component is being released, the routine proceeds to a step S33, and the high speed component HO2 is computed from the following equation (2):

$$HO2=HO2z+O2IN\times A \quad (2)$$

where: A=oxygen release rate of high speed component HO2.

In steps S34, S35, it is determined whether or not the computed HO2 exceeds the maximum capacity HO2MAX of the high speed component, or whether it is not less than a minimum capacity HO2MIN (=0).

When the high speed component HO2 is greater than the maximum capacity HO2MAX, the routine proceeds to a step S36, the overflow oxygen amount (excess amount) OVERFLOW flowing out without being stored as the high speed component HO2 is computed from the following equation (3):

$$\text{OVERFLOW}=HO2-HO2\text{MAX} \quad (3)$$

and the high speed component HO2 is limited to the maximum capacity HO2MAX.

When the high speed component HO2 is less than the minimum capacity HO2MIN, the routine proceeds to a step S37, the overflow oxygen amount (deficiency amount) OVERFLOW which was not stored as the high speed component HO2 is computed by the following equation (4):

$$\text{OVERFLOW}=HO2-HO2\text{MIN} \quad (4)$$

and the high speed component HO2 is limited to the minimum capacity HO2MIN. Here, zero is given as the minimum capacity HO2MIN, so the oxygen amount which is deficient when all the high speed component HO2 has been released is computed as a negative overflow oxygen amount.

When the high speed component HO2 lies between the maximum capacity HO2MAX and minimum capacity HO2MIN, the oxygen excess/deficiency amount O2IN of the exhaust flowing into the catalyst 3 is all stored as the high speed component HO2, and zero is set to the overflow oxygen amount OVERFLOW.

Here, when the high speed component HO2 is greater than the maximum capacity HO2MAX or less than the minimum capacity HO2MIN, the overflow oxygen amount OVERFLOW which has overflowed from the high speed component HO2 is stored as the low speed component LO2.

Figure 6:
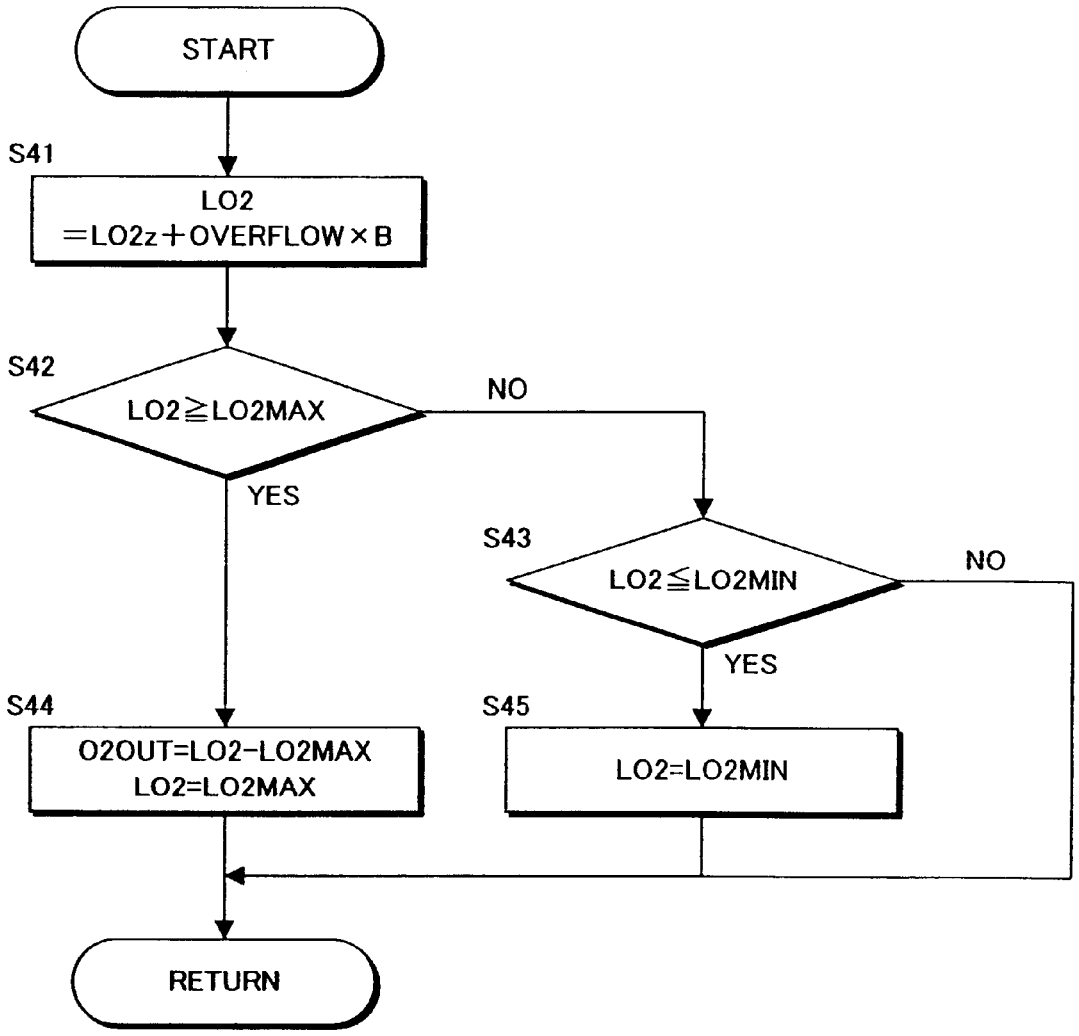
FIG. 6 is a flowchart showing a subroutine for computing a low speed component of the oxygen storage amount.

FIG. 6 shows a subroutine for computing the low speed component LO2 of the oxygen storage amount. In this subroutine, the low speed component LO2 is computed based on the overflow oxygen amount OVERFLOW in steps S36–S38 which has overflowed from the high speed component HO2.

According to this, in a step S41, the low speed component LO2 is computed by the following equation (5):

$$LO2=LO2z+\text{OVERFLOW}\times B \quad (5)$$

where:

LO2z=immediately preceding value of low speed component LO2, and

B=oxygen storage/release rate of low speed component.

Here, the oxygen storage/release rate B of the low speed component is set to a positive value less than or equal to 1, but actually has different characteristics for storage and release. Further, the real storage/release rate is affected by the catalyst temperature TCAT and the low speed component LO2, so the storage rate and release rate can be set to vary independently. In this case, when the overflow oxygen amount OVERFLOW is positive, oxygen is in excess, and the oxygen storage rate at this time is set to for example a value which is larger the higher the catalyst temperature TCAT or the smaller the low speed component LO2. Also, when the overflow oxygen amount OVERFLOW is negative, oxygen is deficient, and the oxygen release rate at this time may for example be set to a value which is larger the higher the catalyst temperature TCAT or the larger the low speed component LO2.

In steps S42, S43, in the same way as when the high speed component HO2 is computed, it is determined whether or not the computed low speed component LO2 has exceeded a maximum capacity LO2MAX or is less than a minimum capacity LO2MIN (=0).

When maximum capacity LO2MAX is exceeded, the routine proceeds to a step S44, an oxygen excess/deficiency amount O2OUT which has overflowed from the low speed component LO2 is computed from the following equation (6):

$$LO2\text{OUT}=LO2-LO2\text{MAX} \quad (6)$$

and the low speed component LO2 is limited to the maximum capacity LO2MAX. The oxygen excess/deficiency amount O2OUT flows out downstream of the catalyst 3.

When the low speed component LO2 is less than the minimum capacity, the routine proceeds to a step S45, and the low speed component LO2 is limited to the minimum capacity LO2MIN.

Figure 7:
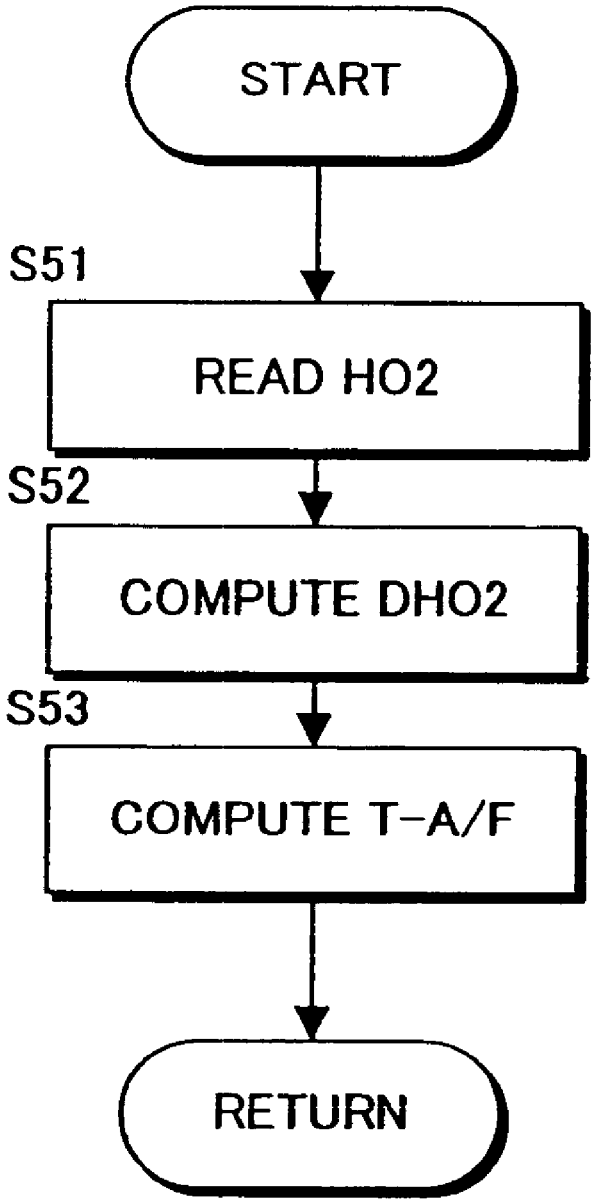
FIG. 7 is a flowchart showing a routine for computing a target air-fuel ratio based on the oxygen storage amount.

FIG. 7 shows a routine for computing a target air-fuel ratio based on the oxygen storage amount (second air-fuel ratio control).

According to this, in a step S51, the high speed component HO2 of the present oxygen storage amount is read. In a step S52, a deviation DHO2 (=oxygen excess/deficiency amount required by catalyst 3) between the current high speed component HO2 and a target value TGHO2 of the high speed component, is computed. The target value TGHO2 of the high speed component is set to, for example, half of the maximum capacity HO2MAX of the high speed component.

In a step S53, the computed deviation DHO2 is converted to an air-fuel ratio equivalent value, and a target air-fuel ratio T-A/F of the engine 1 is set.

Therefore, according to this routine, when the high speed component HO2 of the oxygen storage amount does not reach a target amount, the target air-fuel ratio of the engine 1 is set to lean, and the oxygen storage amount (high speed component HO2) is increased. On the other hand, when the high speed component HO2 exceeds the target amount, the target air-fuel ratio of the engine 1 is set to rich, and the oxygen storage amount (high speed component HO2) is decreased.

Next, according to this invention, the controller 6 determines whether or not the output of the upstream air-fuel ratio sensor 4 which is used for computing the oxygen storage amount is normal, and if the output is shifted (fluctuates) to rich or lean due to sensor deterioration for example, the output of the air-fuel ratio sensor 4 is corrected accordingly to prevent impairment of the computational precision of the oxygen storage amount.

When there is an error in the output of the air-fuel ratio sensor 4 upstream of the catalyst, the oxygen storage amount of the catalyst 3 which is controlled based thereupon drifts from the target value.

For example, when the output of the upstream air-fuel ratio sensor 4 is apparently shifted to rich from the normal state, it is determined that the oxygen storage amount is insufficient, and the air-fuel ratio is controlled to lean. As long as this state continues, the oxygen storage amount of the catalyst 3 becomes saturated, and the downstream air-fuel ratio becomes leaner than stoichiometric.

Therefore, when the air-fuel ratio downstream of the catalyst 3 continues to be lean or rich for more than a given time although it is controlled to stoichiometric, it is determined that there was a fluctuation (output shift) in the output of the upstream air-fuel ratio sensor 4, and the output of the upstream air-fuel ratio sensor 4 is corrected so that the air-fuel ratio becomes stoichiometric.

Figure 8:
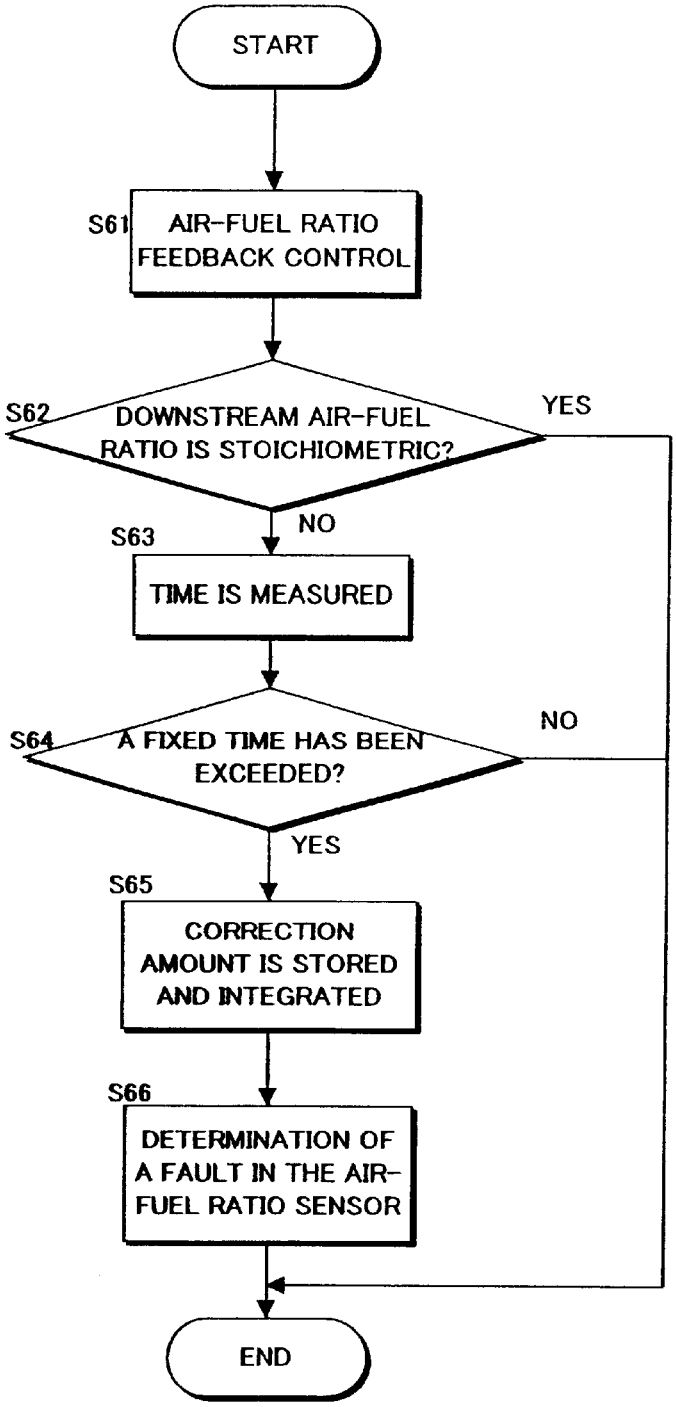
FIG. 8 is a flowchart showing a routine for correcting the output of an air-fuel ratio sensor up stream of the catalyst.

This control will now be described in more detail referring to the flowchart of FIG. 8.

In the running state where the basic air-fuel ratio is stoichiometric, this flow is repeated at a fixed interval in the controller 6.

In a step S61, air-fuel ratio feedback control is performed so that the oxygen storage amount of the catalyst 3 is the target value (half of the maximum oxygen storage amount) based on the output of the upstream air-fuel ratio sensor 4.

Here, the computed value and target value of the oxygen storage amount are compared, a value corresponding to their difference is taken as a correction value, the basic air-fuel ratio is corrected by this correction value to determine the target air-fuel ratio, and a fuel supply amount to the engine 1 is controlled to give this target air-fuel ratio.

Next, in a step S62, it is determined whether or not the downstream air-fuel ratio is stoichiometric from the output of the air-fuel ratio sensor 5 downstream of the catalyst 3, and when it is stoichiometric, the routine is terminated.

Normally, the exhaust air-fuel ratio downstream of the catalyst 3 is stoichiometric due to the oxygen storage performance of the catalyst 3, but the downstream air-fuel ratio varies towards lean or rich when the oxygen storage amount of the catalyst 3 becomes saturated or when all the oxygen is released.

When it is determined that the downstream air-fuel ratio is not stoichiometric, the routine proceeds to a step S63, and the time for which the air-fuel ratio has been rich or lean is measured.

In a step S64, it is determined whether or not the time for which the air-fuel ratio has been lean or rich has reached a fixed time (e.g., 30 seconds). If the fixed time has been exceeded, it is determined that the output of the upstream air-fuel ratio sensor 4 has shifted from the normal value, the routine proceeds to a step S65, and a shift amount (amount to be corrected) relative to the output of the upstream air-fuel ratio sensor 4 is computed. The computation of this shift amount may be performed as follows.

When the output of the upstream air-fuel ratio sensor 4 is apparently shifted (shifted from the normal value) to richer than the real air-fuel ratio, the oxygen storage amount computed based on this sensor output is less than the target storage amount. As a result, control is performed to increase the oxygen storage amount to the target value, i.e., the air-fuel ratio is controlled to lean. If this control is continued, the oxygen storage amount of the catalyst 3 gradually becomes saturated, and the downstream air-fuel ratio becomes leaner than stoichiometric.

In this case therefore, a correction is performed towards lean by a fixed amount relative to the output of the upstream air-fuel ratio sensor 4.

On the other hand, when the output of the upstream air-fuel ratio sensor 4 is apparently shifted to leaner than the real air-fuel ratio, the real oxygen storage amount is less than the target storage amount and gradually tends to zero, and the downstream air-fuel ratio becomes richer than stoichiometric. In this case, a correction is performed towards rich by a fixed amount relative to the output of the upstream air-fuel ratio sensor 4.

Feedback control of the air-fuel ratio is then performed based on these corrected outputs of the air-fuel ratio sensor 4.

The above correction results are stored as learned values of air-fuel ratio control, and when several corrections are to be applied, they are progressively integrated.

This correction amount need not be a fixed value, and may be made to vary according to the magnitude of the absolute value of the output of the downstream air-fuel ratio sensor 5. In this case, the oxygen storage amount is made to vary to the target value in a short time after the correction.

In a step S66, any fault in the upstream air-fuel ratio sensor 4 is determined based on the integrated value of the correction amount relative to this sensor output.

In this determination, the correction value of the upstream air-fuel ratio sensor 4 is integrated, and when the absolute value of this integration amount has reached a predetermined limiting value, it is determined that there is a fault in the air-fuel ratio sensor 4. In this state, the degree of deterioration of the air-fuel ratio sensor 4 is large, it is difficult to perform stable air-fuel ratio control and there may be an adverse impact on exhaust performance. Hence, by determining faults and giving appropriate warnings, the driver is encouraged to perform early repairs or replacements.

When the downstream air-fuel ratio sensor 5 is showing lean, the shift correction amount of the output is computed as a positive fixed value, and when it is showing rich, it is computed as a negative fixed value. When the absolute value of these integrated correction values reaches a preset limiting value, it is determined that there is a fault.

Next, the overall operation will be described.

When the oxygen storage amount of the catalyst 3 is controlled to the target value, e.g., about ½ of the maximum storage amount, the catalyst atmosphere is controlled to stoichiometric even if the upstream air-fuel ratio is slightly lean or rich, and the catalyst 3 purifies NOx, HC and CO with high efficiency.

The oxygen storage amount is computed based on the output of the upstream air-fuel ratio sensor 4, and when this falls below the target value, the air-fuel ratio is controlled to lean and the storage amount is increased. Conversely, when it increases beyond the target value, the air-fuel ratio is controlled to rich, and the storage amount is decreased. As a result, when the oxygen storage amount of the catalyst 3 is always controlled to the target value, the air-fuel ratio downstream of the catalyst 3 becomes stoichiometric, and is never lean or rich.

However, the upstream air-fuel ratio sensor 4 deteriorates with time, and if the sensor output shifts from the normal state, it is detected that the air-fuel ratio is leaner or richer than it really is. In such a case, a precise storage amount cannot be calculated even if the oxygen storage amount is computed based on the output of the air-fuel ratio sensor 4, and the oxygen storage amount of the catalyst 3 may become saturated or all the oxygen may be released.

In this case, the air-fuel ratio downstream of the catalyst varies from stoichiometric to rich or lean. Assume now that the downstream air-fuel ratio has been lean for more than a fixed time. In this state, the output of the upstream air-fuel ratio sensor 4 is shifted to rich compared to the real air-fuel ratio. Therefore, the sensor output is corrected to shift it to lean by a fixed amount. When the output of the air-fuel ratio sensor 4 is shifted to lean relatively by this correction, the real air-fuel ratio is appropriately corrected to rich and the target air-fuel ratio is obtained.

When the output of the air-fuel ratio sensor 4 is shifted in the reverse direction to the above, a correction is applied in the same way, but in this case the direction of the correction is the reverse of the above.

By performing this control, the oxygen storage amount can be made to converge to the target value even if there is a shift in the output of the upstream air-fuel ratio sensor 4.

Figure 9A:
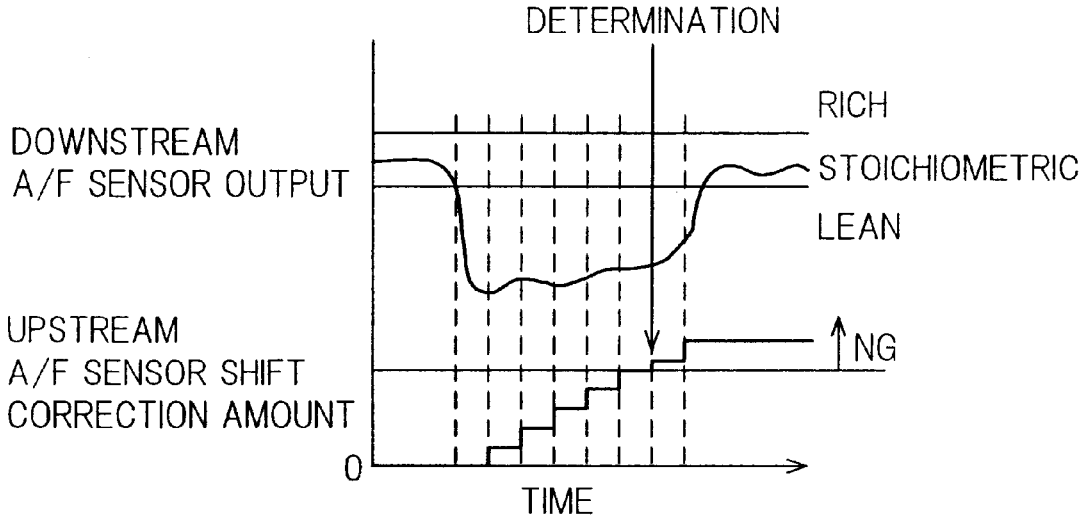
FIGS. 9(A) and 9(B) are descriptive views showing a relation between an air-fuel ratio downstream of the catalyst and a correction amount of an air-fuel ratio sensor upstream of the catalyst, (A) shows the case where the downstream air-fuel ratio is lean, and (B) shows the case where it is rich.
Figure 9B:
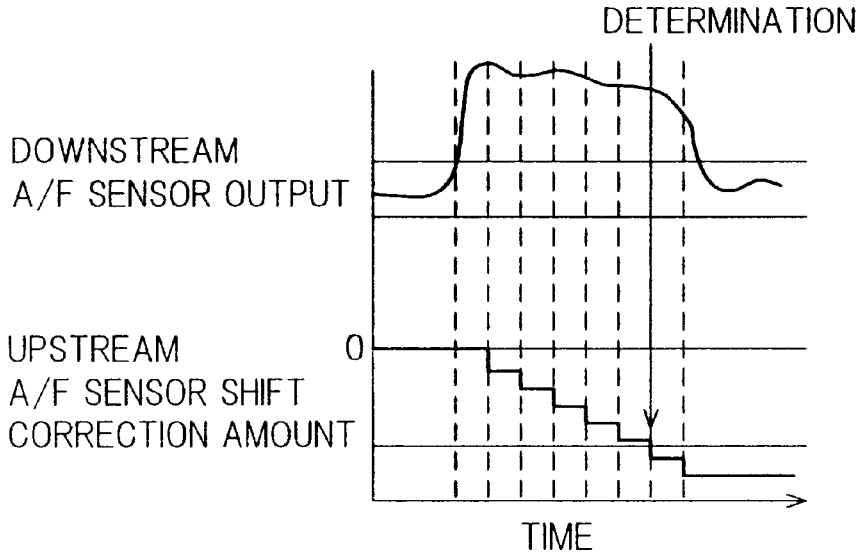

When the output of the upstream air-fuel ratio sensor 4 is largely shifted as shown in FIGS. 9(A), (B), the downstream air-fuel ratio does not becomes stoichiometric if the air-fuel ratio sensor output is corrected only once, and plural corrections are required until the stoichiometric air-fuel ratio is obtained.

However, when the correction is applied in the same direction plural times, there is a high possibility that the sensor deterioration will largely increase, so if the absolute value of the correction value of the sensor output has reached the limiting value, it is determined that the air-fuel ratio sensor 4 has a fault, and the driver is encouraged to replace the air-fuel ratio sensor 4 with a new sensor.

In the above control, each correction to the output of the upstream air-fuel ratio sensor 4 was a fixed amount, so a large fluctuation of air-fuel ratio due to the correction is avoided, and the combustion state of the engine 1 can be stabilized. On the other hand, if the magnitude of the correction to the output of the air-fuel ratio sensor 4 is made to vary according to the output of the downstream air-fuel ratio sensor 5 at that time, the oxygen storage amount due to the correction can be made to return to the target value more quickly, and the purification efficiency of the catalyst 3 can be normalized at an early stage.

Figure 10:
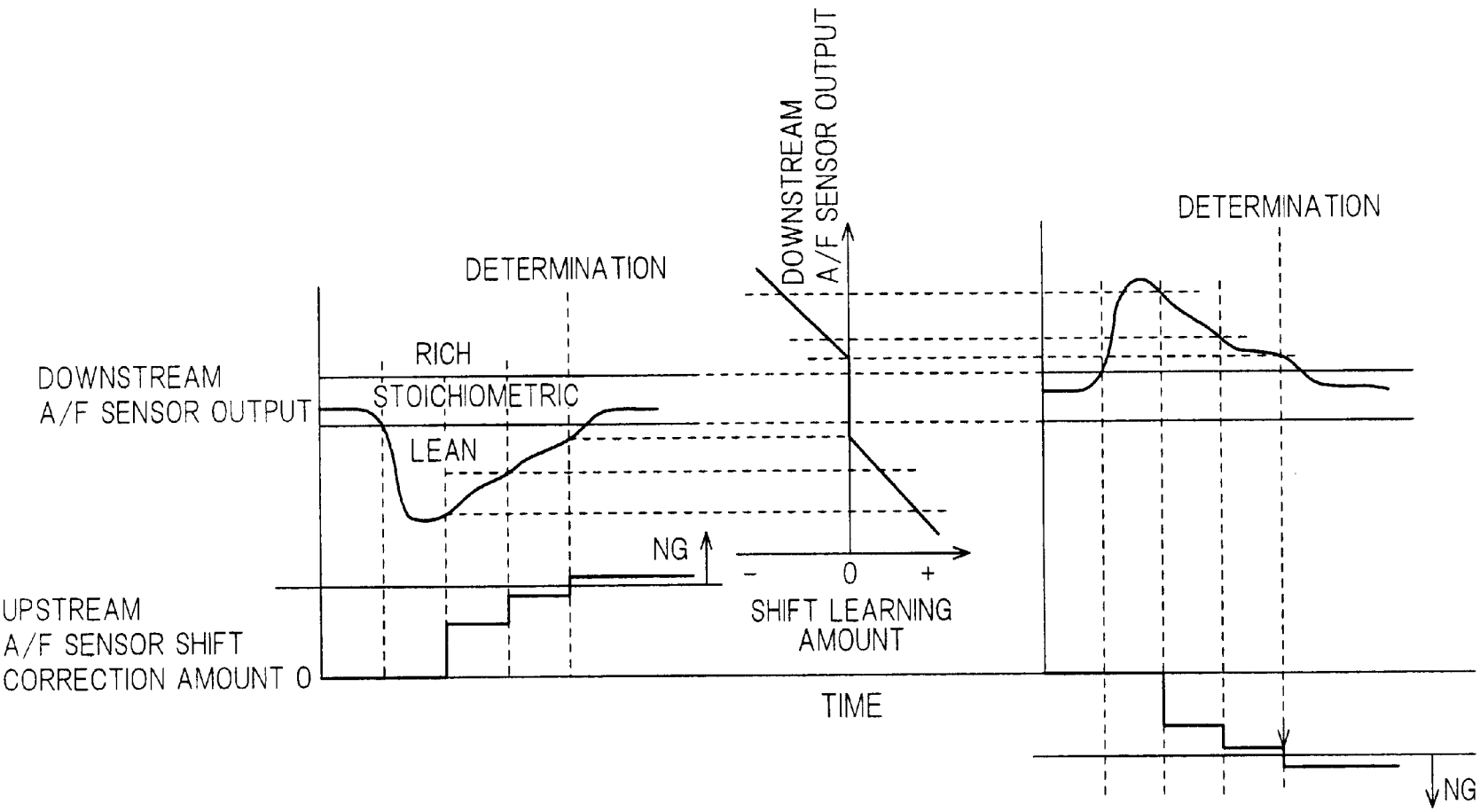
FIG. 10 is a descriptive view showing a relation between the air-fuel ratio downstream of the catalyst and the correction amount of the air-fuel ratio sensor upstream of the catalyst.

Regarding the correction amount of the upstream air-fuel ratio sensor 4, if the value depending on the output of the downstream air-fuel ratio sensor 5, i.e., the variation amount to rich or lean, is large as shown in FIG. 10, the correction amount may also be set to be larger accordingly.

In this way, when the shift amount of the upstream air-fuel ratio sensor 4 is large, the correction amount can be increased and the catalyst oxygen storage amount can be returned to the normal state quickly.

Figure 11:
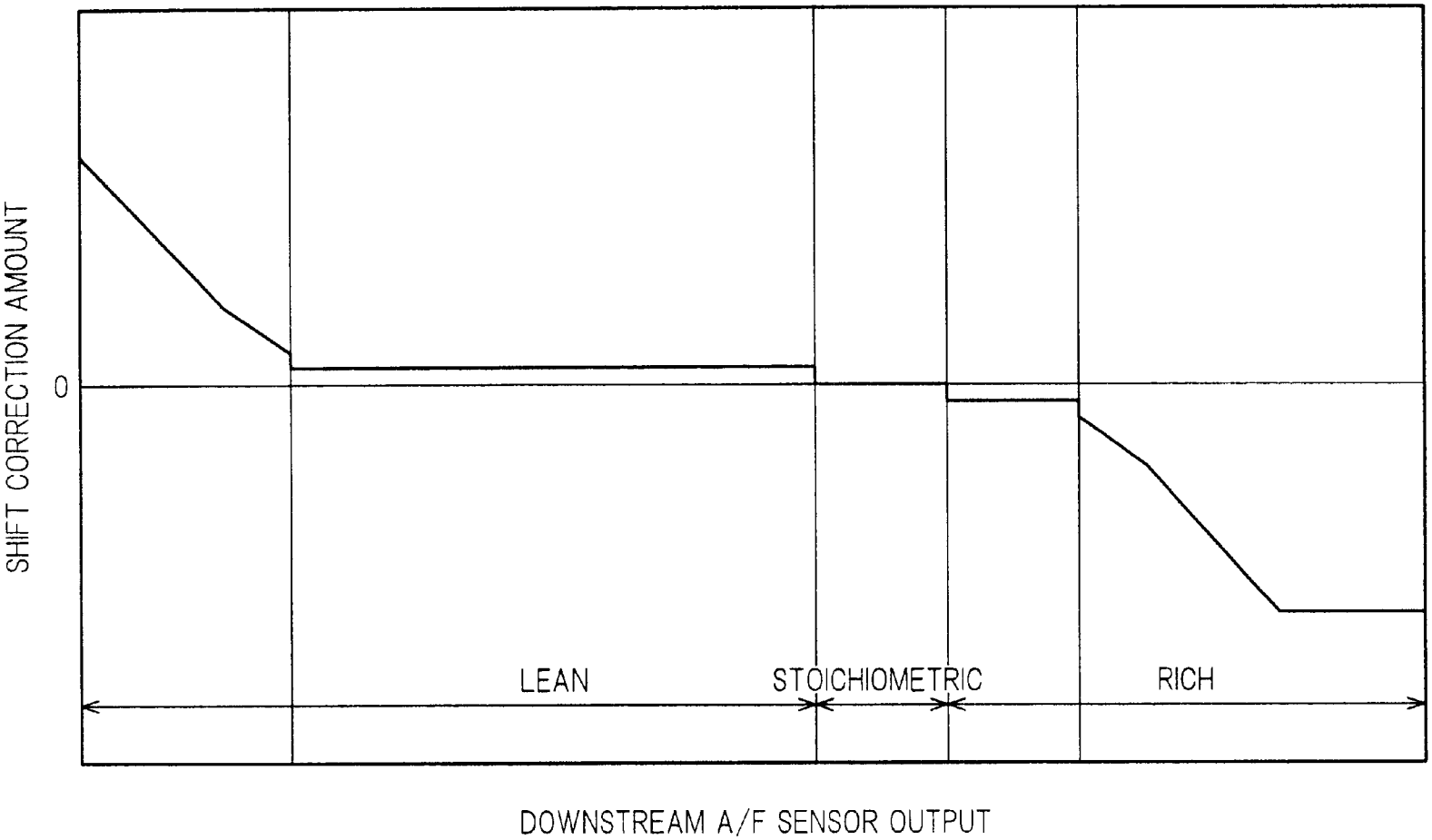
FIG. 11 is a descriptive view of correction amount assignment showing a relation between the air-fuel ratio downstream of the catalyst and the correction amount of the air-fuel ratio sensor upstream of the catalyst.

Further, as shown in FIG. 11, regarding the output characteristics of the upstream air-fuel ratio sensor 4, the downstream air-fuel ratio may fluctuate to rich or lean even if there is no shift in the sensor output, and the fluctuation to lean is larger than the fluctuation to rich. As a result, a fixed amount correction may be performed up to a predetermined limit even if the downstream air-fuel ratio has fluctuated to rich or lean, and the correction amount increased according to the downstream air-fuel ratio if this limit is exceeded.

If this method is adopted, a suitable correction can be performed according to the characteristics of the upstream air-fuel ratio sensor 4, i.e., unnecessary corrections are avoided when there is no sensor shift, and when the shift amount is large, the system can be rapidly restored to the normal oxygen storage amount.

Next, another embodiment will be described.

In this embodiment, the target air-fuel ratio is adjusted in a direction to increase the oxygen storage amount when the air-fuel ratio downstream of the catalyst is rich, and is adjusted in a direction to decrease the oxygen storage amount when it is lean, regardless of the fact that the target air-fuel ratio is the stoichiometric air-fuel ratio. When the air-fuel ratio downstream of the catalyst does not return to stoichiometric despite this adjustment and is on the same side as prior to the adjustment, it is considered that the output of the upstream air-fuel ratio sensor 4 has shifted, and the output of the air-fuel ratio sensor 4 is corrected accordingly.

Figure 12:
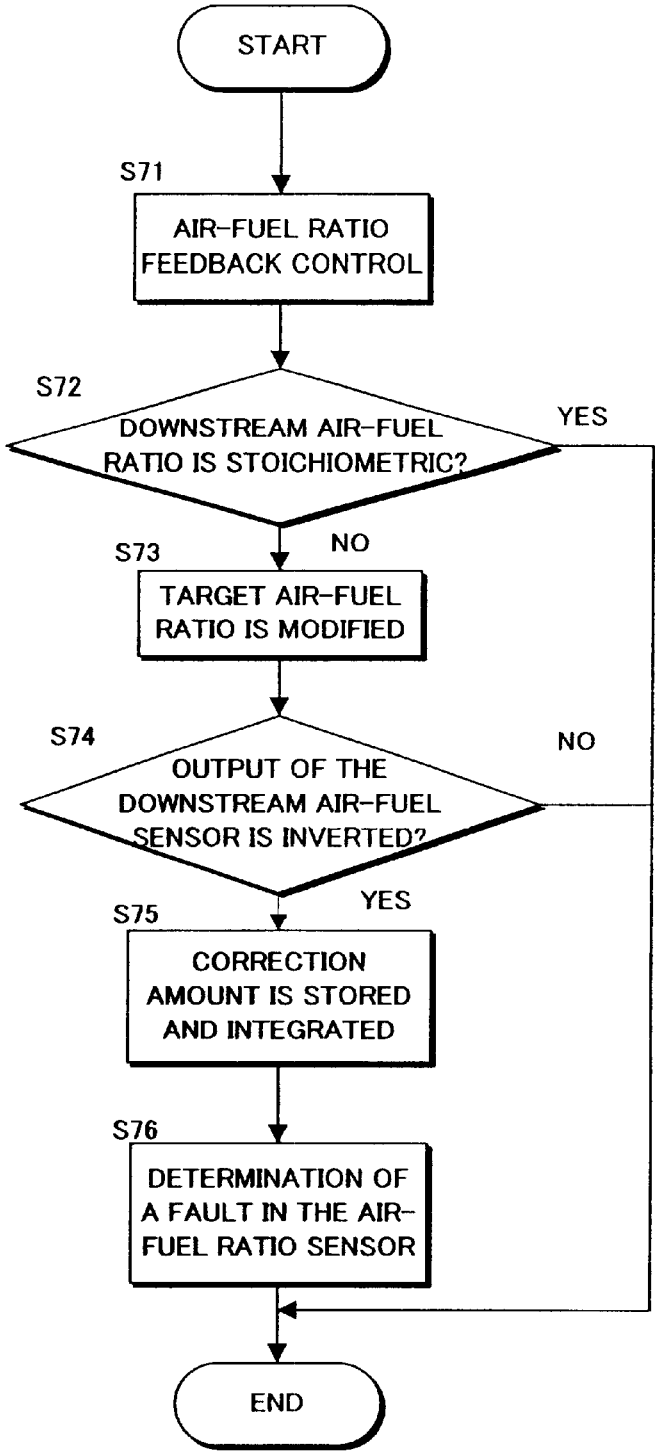
FIG. 12 is a flowchart showing a routine for correcting the output of the air-fuel ratio sensor upstream of the catalyst in another embodiment of this invention.

This control will be described in more detail referring to the flowchart of FIG. 12.

In the running state when the basic air-fuel ratio is stoichiometric, this flow is performed at a fixed interval by the controller 6.

In a step S71, the air-fuel ratio is controlled so that the oxygen storage amount of the catalyst 3 is a target value based on the output of the air-fuel ratio sensor 4 upstream of the catalyst 3. The target air-fuel ratio is determined based on a comparison of the computed value and the target value of the oxygen storage amount, and the fuel supply amount to the engine 1 is controlled to obtain this target air-fuel ratio.

Next, it is determined in a step S72 whether or not the air-fuel ratio is stoichiometric from the output of the downstream air-fuel ratio sensor 5, and when it is stoichiometric, control is terminated. Normally, the exhaust air-fuel ratio downstream of the catalyst 3 is stoichiometric due to the oxygen storage performance of the catalyst 3, but the downstream air-fuel ratio does fluctuate from stoichiometric when the oxygen storage amount of the catalyst 3 becomes saturated or all the oxygen is released.

When it is determined that it is not stoichiometric, the routine proceeds to a step S73, and the target value of air-fuel ratio control is modified by a predetermined amount. Specifically, when the detected air-fuel ratio is lean, the target air-fuel ratio is set to be richer by a predetermined value, and when it is rich, the target air-fuel ratio is set to be leaner by a fixed amount. Due to this control, the air-fuel ratio downstream of the catalyst 3 respectively vary towards the opposite side to the air-fuel ratio until then.

In a step S74, it is determined whether the output of the upstream air-fuel ratio sensor 4 has remained on the same side of stoichiometric or inverted due to variation of this target air-fuel ratio. If it is on the same side, i.e., when the target air-fuel ratio remains lean or rich despite modification, it is determined that there has been a shift in the output of the upstream air-fuel ratio sensor 4, a shift amount is computed relative to the output of the upstream air-fuel ratio sensor 4 in a step S75, and this is fed back to the air-fuel ratio control.

The computation of this shift amount is performed as follows.

Figures 13A, 13B:
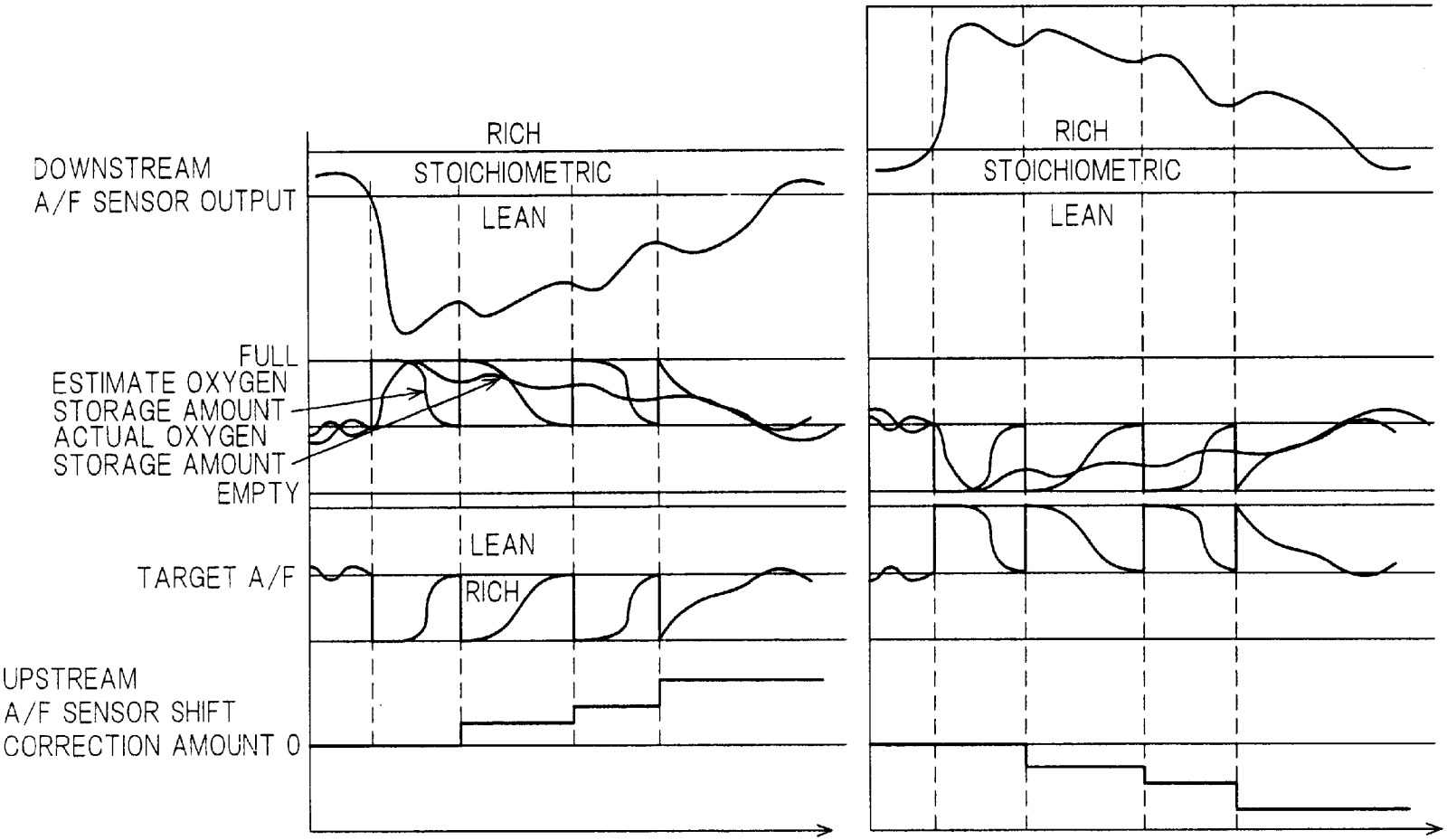
FIGS. 13(A) and 13(B) are descriptive views showing a relation between the air-fuel ratio downstream of the catalyst and the correction amount of the air-fuel ratio sensor upstream of the catalyst, (A) shows the case where the downstream air-fuel ratio is lean, and (B) shows the case where it is rich.

When the detected downstream air-fuel ratio is lean, and the downstream air-fuel ratio is still lean despite the target air-fuel ratio being modified towards rich, the oxygen storage amount of the catalyst 3 is effectively saturated as shown also in FIG. 13(A).

This is the reason why the real air-fuel ratio does not become so rich even if it is on the rich side. When there is a shift (shift from the normal value) in the output of the upstream air-fuel ratio sensor 4, the real air-fuel ratio does not become so rich even if it is feedback-controlled to obtain the target value based on the sensor output. This is due to the fact that the air-fuel ratio sensor 4 apparently outputs a richer output than the real air-fuel ratio. Therefore, in this case, a correction is performed towards lean by a certain amount relative to the output of the upstream air-fuel ratio sensor 4, and this is fed back to air-fuel ratio control.

On the other hand, when the detected downstream air-fuel ratio is rich, and the downstream air-fuel ratio is still rich although the target air-fuel ratio has been modified to be leaner, it may be considered that, conversely to the above case, the output of the upstream air-fuel ratio sensor 4 has apparently been shifted leaner than the real air-fuel ratio, and a correction is performed to rich by a certain amount relative to the output of the upstream air-fuel ratio sensor 4 to correct for this, as shown in FIG. 13(B).

Hence, in the step S75, by computing the correction amount relative to the shift in the output of the upstream air-fuel ratio sensor 4 and feeding this back to air-fuel ratio control, the oxygen storage amount can be made to converge to the target value.

Regarding this correction amount, it may also be made to vary not by a fixed amount, but according to the magnitude of the absolute value of the output of the downstream air-fuel ratio sensor 5. In this case, the oxygen storage amount can be made to converge to the target value soon after the correction.

In a step S76, faults in the upstream air-fuel ratio sensor 4 are determined as described in the above embodiment by determining whether the integrated value of the shift correction amount relative to the sensor output is greater than a predetermined value.

The entire contents of Japanese Patent Application 2000-460980(filed Feb. 23, 2000) and 2000-46104(filed Feb. 23, 2000) are incorporated herein by reference.

This invention is not limited to the above embodiments, various modifications being possible by those skilled in the art within the scope of the appended claims.

What is claimed is:

1. An engine air-fuel ratio controller, comprising:

a catalyst installed in an exhaust passage which absorbs oxygen when an exhaust air-fuel ratio is lean, and releases the absorbed oxygen when the exhaust air-fuel ratio is rich;

means for detecting an air-fuel ratio upstream of the catalyst;

means for detecting an air-fuel ratio downstream of the catalyst;

means for controlling a fuel supply amount of the engine to obtain the stoichiometric air-fuel ratio, which is a target air-fuel ratio, based on the detection value of the upstream air-fuel ratio;

means for estimating the oxygen storage amount absorbed by the catalyst based on the detection value of the upstream air-fuel ratio;

means for modifying the target air-fuel ratio so that the estimated oxygen storage amount coincides with the target value;

means for determining whether or not there is an error in the output of the upstream air-fuel ratio detecting means based on the detection value of the downstream air-fuel ratio;

means for correcting the detection value of the upstream air-fuel ratio detecting means according to the determination result; and means for determining that there is a fault in the upstream air-fuel ratio sensor when the absolute value of the integral of the detection values of the upstream air-fuel ratio sensor exceeds a predetermined value.

2. An engine air-fuel ratio control method, the engine comprising a catalyst installed in an exhaust passage which absorbs oxygen when an exhaust air-fuel ratio is lean, and releases the absorbed oxygen when the exhaust air-fuel ratio is rich, an air-fuel ratio sensor installed upstream of the catalyst, which detects an air-fuel ratio upstream of the catalyst, an air-fuel ratio sensor installed downstream of the catalyst, which detects an air-fuel ratio downstream of the catalyst, the method comprising:

controlling a fuel supply amount of the engine to obtain the stoichiometric air-fuel ratio, which is a target air-fuel ratio, based on the detection value of the upstream air-fuel ratio sensor;

estimating the oxygen storage amount absorbed by the catalyst based on the detection value of the upstream air-fuel ratio sensor;

modifying the target air-fuel ratio so that the estimated oxygen storage amount coincides with the target value;

determining whether or not there is an error in the output of the upstream air-fuel ratio sensor based on the detection value of the downstream air-fuel ratio sensor;

correcting the detection value of the upstream air-fuel ratio sensor according to this determination result; and determining that there is a fault in the upstream air-fuel ratio sensor when the absolute value of the integral of the detection values of the upstream air-fuel ratio sensor exceeds a predetermined value.

3. An engine air-fuel ratio controller, comprising:

a catalyst installed in an exhaust passage which absorbs oxygen when an exhaust air-fuel ratio is lean, and releases the absorbed oxygen when the exhaust air-fuel ratio is rich;

means for detecting an air-fuel ratio upstream of the catalyst;

means for detecting an air-fuel ratio downstream of the catalyst;

means for controlling a fuel supply amount of the engine to obtain the stoichiometric air-fuel ratio, which is a target air-fuel ratio, based on the detection value of the upstream air-fuel ratio;

means for estimating the oxygen storage amount absorbed by the catalyst based on the detection value of the upstream air-fuel ratio;

means for modifying the target air-fuel ratio so that the estimated oxygen storage amount coincides with the target value;

means for determining whether or not there is an error in the output of the upstream air-fuel ratio detecting means based on the detection value of the downstream air-fuel ratio;

means for correcting the detection value of the upstream air-fuel ratio detecting means according to the determination result; and means for computing the oxygen storage amount separately as a high-speed component which is absorbed at a fast rate by the catalyst, and a low speed component which is absorbed at a slower rate than this high-speed component.

4. An engine air-fuel ratio control method, the engine comprising a catalyst installed in an exhaust passage which absorbs oxygen when an exhaust air-fuel ratio is lean, and releases the absorbed oxygen when the exhaust air-fuel ratio is rich, an air-fuel ratio sensor installed upstream of the catalyst, which detects an air-fuel ratio upstream of the catalyst, an air-fuel ratio sensor installed downstream of the catalyst, which detects an air-fuel ratio downstream of the catalyst, the method comprising:

controlling a fuel supply amount of the engine to obtain the stoichiometric air-fuel ratio, which is a target air-fuel ratio, based on the detection value of the upstream air-fuel ratio sensor;

estimating the oxygen storage amount absorbed by the catalyst based on the detection value of the upstream air-fuel ratio sensor;

modifying the target air-fuel ratio so that the estimated oxygen storage amount coincides with the target value;

determining whether or not there is an error in the output of the upstream air-fuel ratio sensor based on the detection value of the downstream air-fuel ratio sensor, correcting the detection value of the upstream air-fuel ratio sensor according to this determination result; and computing the oxygen storage amount separately as a high-speed component which is absorbed at a fast rate by the catalyst, and a low speed component which is absorbed at a slower rate than this high-speed component.

5. An engine air-fuel ratio controller, comprising:

a catalyst installed in an exhaust passage which absorbs oxygen when an exhaust air-fuel ratio is lean, and releases the absorbed oxygen when the exhaust air-fuel ratio is rich;

an air-fuel ratio sensor installed upstream of the catalyst, which detects an air-fuel ratio upstream of the catalyst;

an air-fuel ratio sensor installed downstream of the catalyst, which detects an air-fuel ratio downstream of the catalyst; and a microprocessor programmed to:

control a fuel supply amount of the engine to obtain the stoichiometric air-fuel ratio, which is a target air-fuel ratio, based on the detection value of the upstream air-fuel ratio sensor;

estimate the oxygen storage amount absorbed by the catalyst based on the detection value of the upstream air-fuel ratio sensor;

modify the target air-fuel ratio so that the estimated oxygen storage amount coincides with the target value;

determine whether or not there is an error in the output of the upstream air-fuel ratio sensor based on the detection value of the downstream air-fuel ratio sensor, and correct the detection value of the upstream air-fuel ratio sensor according to this determination result; and determine that there is a fault in the upstream air-fuel ratio sensor when the absolute value of the integral of the detection values of the upstream air-fuel ratio sensor exceeds a predetermined value.

6. An air-fuel ratio controller as defined in claim 5, wherein the microprocessor is further programmed to:

correct the detection value of the upstream air-fuel ratio sensor based on the detection value of the downstream air-fuel ratio sensor, when the detection value of the downstream air-fuel ratio sensor is lean or rich for longer than a fixed time.

7. An air-fuel ratio controller as defined in claim 6, wherein the correction of the detection value of the upstream air-fuel ratio sensor is shifted by a fixed amount to lean when the downstream air-fuel ratio sensor is lean, and is shifted by a fixed amount to rich when the downstream air-fuel ratio sensor is rich.

8. An air-fuel ratio controller as defined in claim 6, wherein the correction of the detection value of the upstream air-fuel ratio sensor is shifted to lean according to the sensor output value when the downstream air-fuel ratio sensor is lean, and is shifted to rich according to the sensor output value when the downstream air-fuel ratio sensor is rich.

9. An air-fuel ratio controller as defined in claim 6, wherein the correction of the detection value of the upstream air-fuel ratio sensor is shifted to lean by a fixed amount when the downstream air-fuel ratio sensor is lean up to a predetermined limit, shifted to lean according to the sensor output value beyond this limit, shifted to rich by a fixed amount when the downstream air-fuel ratio sensor is rich up to a predetermined limit, and shifted to rich according to the sensor output value beyond this limit.

10. An air-fuel ratio controller as defined in claim 5, wherein the microprocessor is further programmed to:

modify the target air-fuel ratio to be rich when the detection value of the downstream air-fuel ratio sensor is lean, and modify the target air-fuel ratio to be lean when the detection value of the downstream air-fuel ratio sensor is rich; and correct the detection value of the upstream air-fuel ratio sensor when the detection value of the downstream air-fuel ratio sensor is on the same side of stoichiometric as before modification even if the target air-fuel ratio is modified.

11. An air-fuel ratio controller as defined in claim 10, wherein the target air-fuel ratio is varied to rich by a fixed value when the detection value of the downstream air-fuel ratio sensor is lean, and varied to lean by a fixed value when the detection value of the downstream air-fuel ratio sensor is rich.

12. An air-fuel ratio controller as defined in claim 10, wherein the detection value of the upstream air-fuel ratio sensor is shifted to lean by a fixed amount when the downstream air-fuel ratio sensor is lean, and shifted to rich by a fixed amount when the downstream air-fuel ratio is rich.

13. An air-fuel ratio controller as defined in claim 10, wherein the output value of the upstream air-fuel ratio sensor is shifted to lean by an amount corresponding to the sensor output when the detection value of the downstream air-fuel ratio sensor is lean, and is shifted to rich by an amount corresponding to the sensor output when the detection value of the downstream air-fuel ratio sensor is rich.

14. An engine air-fuel ratio controller, comprising:

a catalyst installed in an exhaust passage which absorbs oxygen when an exhaust air-fuel ratio is lean, and releases the absorbed oxygen when the exhaust air-fuel ratio is rich;

an air-fuel ratio sensor installed upstream of the catalyst, which detects an air-fuel ratio upstream of the catalyst;

an air-fuel ratio sensor installed downstream of the catalyst, which detects an air-fuel ratio downstream of the catalyst; and a microprocessor programmed to:

control a fuel supply amount of the engine to obtain the stoichiometric air-fuel ratio, which is a target air-fuel ratio, based on the detection value of the upstream air-fuel ratio sensor;

estimate the oxygen storage amount absorbed by the catalyst based on the detection value of the upstream air-fuel ratio sensor;

modify the target air-fuel ratio so that the estimated oxygen storage amount coincides with the target value;

determine whether or not there is an error in the output of the upstream air-fuel ratio sensor based on the detection value of the downstream air-fuel ratio sensor, and correct the detection value of the upstream air-fuel ratio sensor according to this determination result; and compute the oxygen storage amount separately as a high-speed component which is absorbed at a fast rate by the catalyst, and a low speed component which is absorbed at a slower rate than this high-speed component.

15. An air-fuel ratio controller as defined in claim 14, wherein the microprocessor is further programmed to:

correct the detection value of the upstream air-fuel ratio sensor based on the detection value of the downstream air-fuel ratio sensor, when the detection value of the downstream air-fuel ratio sensor is lean or rich for longer than a fixed time.

16. An air-fuel ratio controller as defined in claim 15, wherein the correction of the detection value of the upstream air-fuel ratio sensor is shifted by a fixed amount to lean when the downstream air-fuel ratio sensor is lean, and is shifted by a fixed amount to rich when the downstream air-fuel ratio sensor is rich.

17. An air-fuel ratio controller as defined in claim 15, wherein the correction of the detection value of the upstream air-fuel ratio sensor is shifted to lean according to the sensor output value when the downstream air-fuel ratio sensor is lean, and is shifted to rich according to the sensor output value when the downstream air-fuel ratio sensor is rich.

18. An air-fuel ratio controller as defined in claim 15, wherein the correction of the detection value of the upstream air-fuel ratio sensor is shifted to lean by a fixed amount when the downstream air-fuel ratio sensor is lean up to a predetermined limit, shifted to lean according to the sensor output value beyond this limit, shifted to rich by a fixed amount when the downstream air-fuel ratio sensor is rich up to a predetermined limit, and shifted to rich according to the sensor output value beyond this limit.

19. An air-fuel ratio controller as defined in claim 14, wherein the microprocessor is further programmed to:

modify the target air-fuel ratio to be rich when the detection value of the downstream air-fuel ratio sensor is lean, and modify the target air-fuel ratio to be lean when the detection value of the downstream air-fuel ratio sensor is rich, and correct the detection value of the upstream air-fuel ratio sensor when the detection value of the downstream air-fuel ratio sensor is on the same side of stoichiometric as before modification even if the target air-fuel ratio is modified.

20. An air-fuel ratio controller as defined in claim 19, wherein the target air-fuel ratio is varied to rich by a fixed value when the detection value of the downstream air-fuel ratio sensor is lean, and varied to lean by a fixed value when the detection value of the downstream air-fuel ratio sensor is rich.

21. An air-fuel ratio controller as defined in claim 19, wherein the detection value of the upstream air-fuel ratio sensor is shifted to lean by a fixed amount when the downstream air-fuel ratio sensor is lean, and shifted to rich by a fixed amount when the downstream air-fuel ratio is rich.

22. An air-fuel ratio controller as defined in claim 19, wherein the output value of the upstream air-fuel ratio sensor is shifted to lean by an amount corresponding to the sensor output when the detection value of the downstream air-fuel ratio sensor is lean, and is shifted to rich by an amount corresponding to the sensor output when the detection value of the downstream air-fuel ratio sensor is rich.

* * * * *